US005860789A

United States Patent [19]

Sekihara et al.

[11] Patent Number: 5,860,789

[45] Date of Patent: Jan. 19, 1999

[54] GAS TURBINE ROTOR

[75] Inventors: Masaru Sekihara, Ibaraki-ken; Takashi Machida, Tsuchiura, both of Japan

[73] Assignee: Hitachi, Ltd., Tokyo, Japan

[21] Appl. No.: 791,510

[22] Filed: Jan. 30, 1997

[30] Foreign Application Priority Data

Mar. 19, 1996 [JP] Japan ..... 8-062483

[51] Int. Cl.[6] ..... F01D 5/06

[52] U.S. Cl. ..... 416/201 R; 416/244 A; 416/248

[58] Field of Search ..... 416/198 A, 200 A, 416/201 R, 244 A, 248, 204 A, 193 A

[56] References Cited

U.S. PATENT DOCUMENTS

| | | | |
|---|---|---|---|
| 4,784,572 | 11/1988 | Novotny et al. | 416/198 A |
| 4,844,694 | 7/1989 | Naudet | 416/198 A |
| 4,880,354 | 11/1989 | Teranishi et al. | 416/198 A |
| 4,901,523 | 2/1990 | Huelster | 416/198 A |
| 5,054,996 | 10/1991 | Carreno . | |

FOREIGN PATENT DOCUMENTS

| | | | |
|---|---|---|---|
| 1135837 | 5/1957 | France | 416/244 A |
| 7533660 | 2/1976 | Germany . | |
| 2555337 | 7/1976 | Germany | 416/244 A |

OTHER PUBLICATIONS

"The prototype–Tested 3A–Series Gas Turbines", pp. I–283 to 289, 95–Yokohama IGTC–145, Presented at 1995 Yokohama International Gas Turbine Congress held Oct. 22, 1995–Oct. 27, 1995.

*Primary Examiner*—Christopher Verdier

*Attorney, Agent, or Firm*—Antonelli, Terry, Stout & Kraus, LLP

[57] ABSTRACT

A gas turbine has a gas turbine rotor including a plurality of rotary disks each having an opening of a circular shape formed through its central portion, the rotary disk including a pair of hub portions formed respectively on opposite sides thereof, and a pair of in-low portions formed respectively at the opposite sides thereof. The gas turbine rotor also includes a plurality of spacers each having an opening of a circular shape formed through its central portion, the spacer having a pair of in-low portions formed respectively at opposite sides thereof. The rotary disks and the spacers are alternately stacked together in such a manner that the opposite sides of each of the spacers contact opposed side surfaces of the adjacent hub portions, respectively, and that the in-low portions of each of the spacers are engaged respectively with the in-low portions of the adjacent rotary disks. The stack of rotary disks and spacers are fastened together in an axial direction by stacking bolts. A thickness of that portion of the rotary disk extending radially from an inner periphery of the hub portions to an inner peripheral surface of the rotary disk is so determined that stresses, developing at the inner peripheral surface of the rotary disk, can be made generally equal to one another over an entire area thereof.

2 Claims, 9 Drawing Sheets

GAS TURBINE ROTOR

BACKGROUND OF THE INVENTION

1. Field of the Invention

This invention relates to a rotor construction of a gas turbine, and more particularly to a gas turbine rotor which can achieve a high-efficiency and large-output design of the gas turbine.

2. Description of the Related Art

A configuration of a conventional rotary disk, used in a gas turbine, is based on an idea of such a design that a hub portion, defining an abutment surface for contact with an adjacent disk, is formed on each side of a disk in the form of an equal-stress disk in which stresses, developing at radial positions, are equal or uniform in the entire radial direction.

Recently, however, in gas turbine facilities, the system has been required to have a high-efficiency in order to save energy and also to protect the environment. One method of achieving such a high-efficiency design is to increase a turbine inlet temperature.

Also, with an increased demand for electric power and particularly with the increase of peak electric power, a gas turbine has been required to produce a large output. One method of achieving such a large-output design is to increase an annular cross-sectional area of a gas flow passage.

With the increase of the turbine inlet temperature, an environmental temperature, to which the rotary disks are exposed, increases. Generally, the strength of a material of which the rotary disks are made is lowered with the increase of the environmental temperature. Therefore, it is necessary to increase the thickness of the rotary disks so as to reduce a developed stress, thereby compensating for the lowered strength of the material.

The increase of the annular cross-sectional area of the gas flow passage invites the increase of a centrifugal force acting on blades, and as a result a stress, developing at a central portion of the rotary disk, increases, and therefore in this case, also, the thickness of the rotary disk need to be increased in order to reduce a developed stress.

As shown in FIG. 8, a conventional gas turbine, in which a gas turbine rotor of the type described is used, broadly comprises a compressor portion 100, a combustor portion 200, and a turbine portion 300. In this gas turbine, the air, drawn from the atmosphere, is compressed in the compressor 100, and in the combustor portion 200, the thus compressed air is mixed with fuel and is burned, thereby producing combustion gas of high temperature and pressure. The thus produced combustion gas is expanded in the turbine portion 300 to produce power, and then is discharged as exhaust gas to the atmosphere. Part of the power, produced in the turbine portion 300, is used to drive the compressor portion 100, and the remainder of the power other than the power used to drive a compressor of the compressor portion 100 serves as driving power for the gas turbine, and a generator (not shown) is driven by this driving power of the gas turbine.

In order to deal with the above increased-thickness problem, there has been proposed a gas turbine rotor of such a gas turbine having the construction shown in FIG. 9. FIG. 9 is a cross-sectional view showing the construction of a turbine portion of a gas turbine V84.3 of Siemens made public at Yokohama International Gas Turbine Institute (1995). More specifically, FIG. 9 is a cross-sectional view of a stacked rotor in which disks, each having a plurality of moving blades fitted therein, are stacked together in a multi-stage manner in a direction of a rotational axis, and a left side is an upstream earlier-stage side while a right side is a downstream later-stage side. In FIG. 9, reference numeral 1 denotes the disk, reference numeral 2 the moving blade, reference numeral 3 a stacking bolt, reference numeral 4 a stationary blade, and reference numeral 5 a shroud. The disks 1 are stacked and fastened together by the stacking bolt. 3 passing through holes formed respectively through central portions of the disks 1.

In order to suppress a large centrifugal stress, produced at the central portion of the rotary disk 1 of FIG. 9 in accordance with centrifugal forces acting on the moving blades 2 and the outer peripheral portion of the disk, to within an allowable range, and also to compensate for the lowered strength of the disk material due to the increase of the environmental temperature, the rotary disk 1, shown in FIG. 9, is increasing in thickness continuously (progressively) toward the central portion thereof, and is increased in thickness at its innermost peripheral portion as much as possible so that the rotary disk 1 almost contacts the adjacent rotary disks 1 at their innermost peripheral portion.

It is expected that gas turbines are required to achieve a higher efficiency and a larger output, and to meet these requirements, if the thickness of the inner peripheral portion of each rotary disk is increased as proposed in the prior art technique, it is possible that the adjacent rotary disks contact each other at their inner peripheral portions, and therefore this method of increasing the thickness of the rotary disk is limited. A surface of a circular hole or opening (hereinafter referred to as "inner hole"), formed through the central portion of the rotary disk, is pulled radially outwardly at its central portion to a larger degree by the tensile centrifugal forces acting on the outer peripheral portion of the disk and the moving blades. Therefore, there occurs the large difference in radial deformation between the central portion of the surface of the central hole and the opposite (right and left) side portions of the surface of the central hole, and the correspondent stress component in the vicinity of the central portion of the surface of the inner hole locally increases since compressive stress components in the direction of the thickness of the rotary disk act on this central portion. Thus, there has been encountered a problem that merely by increasing the thickness of the inner peripheral portion of the rotary disk, this localized peak correspondent stress can not be reduced satisfactorily.

SUMMARY OF THE INVENTION

It is an object of this invention to provide a gas turbine rotor in which a peak correspondent stress, developing at an inner peripheral surface of a rotary disk, is reduced, so that the gas turbine rotor can achieve a high-efficiency and large-output design of a gas turbine.

The above object of the invention has been achieved by the gas turbine rotors having the stractural features described in the following paragraphs (1) to (4). The gas turbine rotors or the present invention comprise a plurality of rotary disks each having a central hole of a circular shape formed through its central portion, the rotary disk including a pair of hub portions (thickened portions) formed respectively on opposite sides thereof, and a pair of in-low portions formed respectively at the opposite sides thereof, and a plurality of spacers each having a central hole of a circular shape formed through its central portion, the spacer having a pair of in-low portions formed respectively at opposite sides thereof, the rotary disks and the spacers being alternately stacked together in such a manner that the opposite sides of each of the spacers contact opposed side surfaces of the adjacent hub portions, respectively, and that the in-low portions of each of the spacers are engaged respectively with the in-low portions of the adjacent rotary disks, and the stack of rotary disks and spacers being fastened together in an axial direction by stacking bolts.

(1) A thickness of that portion of the rotary disk extending radially from an inner periphery of the hub portions to an inner peripheral surface of the rotary disk is so determined that stresses, developing at the inner peripheral surface of the rotary disk, can be made generally equal to one another over an entire area thereof.

(2) A thickness of that portion of the rotary disk extending radially from an inner periphery of the hub portions to an inner peripheral surface of the rotary disk is so determined that the thickness is the largest at a portion between the inner periphery of the hub portions and the inner peripheral surface of the rotary disk, and that the thickness is decreasing continuously from the largest-thickness portion to the inner peripheral surface of the rotary disk.

(3) A thickness of that portion of the rotary disk extending radially from an inner periphery of the hub portions to an inner peripheral surface of the rotary disk is so determined that the thickness is the largest at a portion between the inner periphery of the hub portions and the inner peripheral surface of the rotary disk, the largest-thickness portion extending a predetermined distance radially of the rotary disk, and that the thickness is decreasing continuously from a radially inner end of the largest-thickness portion to the inner peripheral surface of the rotary disk.

(4) In paragraph (2) or paragraph (3), the thickness of the rotary disk is decreasing in a stepped manner from the largest-thickness portion to the inner peripheral surface of the rotary disk in such a manner that part of that portion extending radially from the largest-thickness portion and the inner peripheral surface of the rotary disk has a uniform thickness.

In the above gas turbine rotors of the invention, the thickness of the rotary disk between the opposite (right and left) sides (or surfaces) is increased in the vicinity of a hub-adjoining portion, and therefore centrifugal forces, produced respectively at the opposite side portions, disposed adjacent respectively to the opposite (right and left) sides or surfaces of the rotary disk, in the vicinity of the central portion of the rotary disk disposed radially inwardly of the hub-adjoining portion, are increased. Also, the opposite side portions of the rotary disk are reduced in thickness in the vicinity of the central portion of the rotary disk, thereby reducing the radial rigidity of the opposite side portions in the vicinity of the central portion of the rotary disk. As a result, the radial deformation of those portions of the opposite side portions in the vicinity of the central portion is increased, thereby reducing the difference between the radial deformation of the central portion of the surface of the inner hole and the radial deformation of each of the opposite end portions of the surface of the central hole. And besides, since the rigidity against the radial deformation is increased in the vicinity of the central portion of the rotary disk, the radial deformation of the central portion of the surface of the inner hole is reduced. As a result, at the central portion of the surface of the inner hole, compressive stress components in the direction of the thickness are reduced, so that the peak correspondent stress at the surface of the inner hole can be reduced. The following effects can also be achieved.

The thickness of that portion of the rotary disk extending radially from the inner periphery of the hub portions to the inner peripheral surface of the rotary disk is so determined that the thickness is the largest at a portion between the inner periphery of the hub portions and the inner peripheral surface of the rotary disk, and therefore the radial rigidity of the opposite side portions of the rotary disk is reduced in the vicinity of the central portion of the rotary disk, and besides the rotary disk is reduced in size at its in-low portions engaged with the adjacent spacers, and a sufficient in-low region for the rotary disk can be obtained.

DESCRIPTION OF THE PREFERRED EMBODIMENTS

A preferred embodiment of the present invention will now be described with reference to the drawings.

A gas turbine rotor of the present invention includes rotary disks, moving blades embedded in each of the rotary disks, and stacking bolts extending through the rotary disks arranged in a multi-stage manner to fasten them together. Each of the moving blades has at its proximal end a fir tree embedded in the rotary disk, and grooves are formed in an outer peripheral surface of the rotary disk at a predetermined angle in a direction of a rotational axis or in a circumferential direction, and the fir trees of the moving blades are embedded in these grooves, respectively. A pair of hub portions of a uniform thickness are formed respectively on opposite sides or surfaces of the rotary disk, and define abutment surfaces held in contact with their adjacent spacers, respectively. A plurality of holes are formed through the rotary disk, and are open to the outer surface of the two hub portions, and these holes are equidistant radially from the rotational axis, and are arranged at equal intervals in the circumferential direction. The plurality of rotary disks are staked together in the axial direction, and are fastened together by stacking bolts passing respectively through the group of aligned holes in the rotary disks. The rotary disk has a pair of in-low portions formed respectively at the contact portions contacting the adjacent spacers, respectively. The in-low portions are in mesh with the adjacent spacers, respectively, thereby fixing the rotary disk in the radial direction. A preferred embodiment of the present invention will now be described with reference to the drawings.

Figure 1:
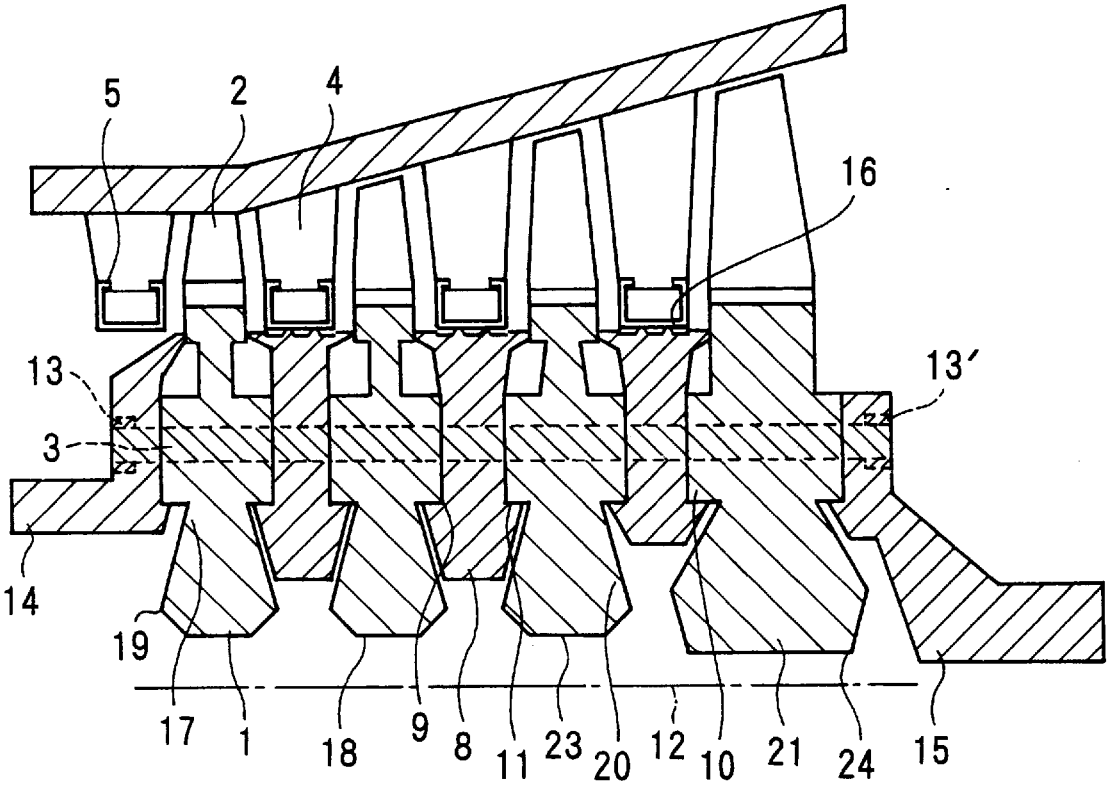
FIG. 1 is a cross-sectional view of a gas turbine rotor construction according to an embodiment of the present invention, which best show features of the invention.
Figure 2B:
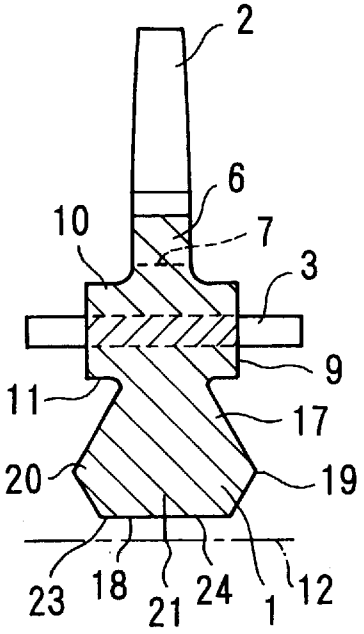
FIG. 2B is a cross-sectional view taken along the line IIB—IIB of FIG. 2A.
Figure 2A:
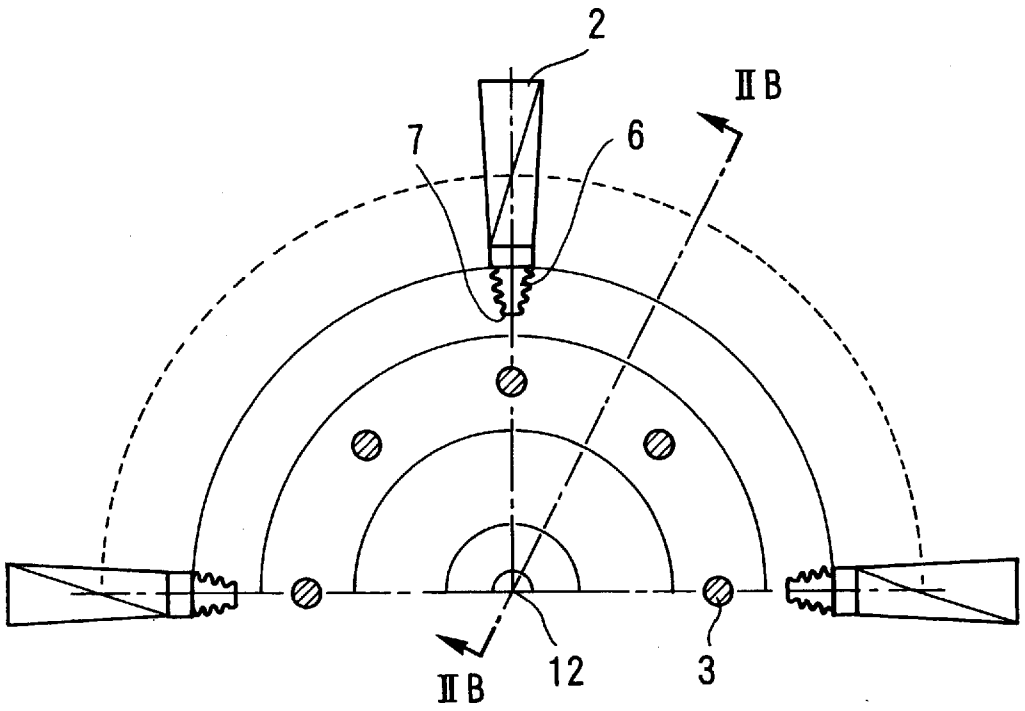
FIG. 2A is a schematic, side-elevational view of a portion of a rotary disk of a gas turbine rotor of the invention, showing fir tree portions of moving blades embedded in the rotary disk.

FIG. 1 is a cross-sectional view of turbine rotary disks, taken along the rotational axis, which best show features of the present invention, and FIGS. 2A and 2B show the rotary disk. In FIGS. 1, 2A and 2B, moving blades 2 and stationary blades 4, each having an inter-blade gas pressure-sealing shroud 5 mounted thereon, are arranged alternately from an upstream side of the turbine to a downstream side of the turbine. Each of the moving blades 2 has a fir tree 6 formed at its proximal end, and the fir tree 6 is embedded in a fir tree groove 7, formed in the outer peripheral surface of the rotary disk 1, so that the moving blade 2 is fixed to the rotary disk 1. A cross-sectional area of a flow passage in the turbine is increasing from the upstream side toward the downstream side, and the outer diameters of the rotary disks 1 tend to increase from the upstream side toward the downstream side. The rotary disk 1 has a pair of hub portions 10 and a pair of in-low portions 11 which are formed respectively at abutment surfaces 9 contacting adjacent spacers 8, respectively. The in-low portions 11 are in mesh with the adjacent spacers 8, respectively, thereby preventing the rotary disk 1 from moving radially. A plurality of bolt holes are formed through the rotary disk 1, and are open to the two abutment surfaces 9, and these bolt holes are equidistant radially from the rotational axis 12. The plurality of rotary disks 1 are staked together in the axial direction, and are fastened together by stacking bolts 3, passing respectively through the group of aligned bolt holes, and nuts 13 and 13' threaded respectively on opposite ends of each of the stacking bolt 3 through a distant piece 14 and a stub shaft 15, so that the group of rotary disks 1 are prevented from moving in the direction of the rotational axis. A labyrinth seal surface 16 is formed on the outer peripheral surface of the spacer 8, and cooperates with the shroud 5 mounted on the distal end of the stationary blade 4.

As shown in FIGS. 1 and 2A and 2B, in the rotary disk 1 of the present invention, the thickness of that portion thereof disposed radially inwardly of the hub portions 10 is the largest as at 19 between a hub-adjoining portion 17 and an inner hole 18 formed through the central portion of the rotary disk 1, and the thickness of the rotary disk 1 is decreasing continuously (progressively) from the largest-thickness portion or position 19 to the inner hole 18.

Figure 3A:
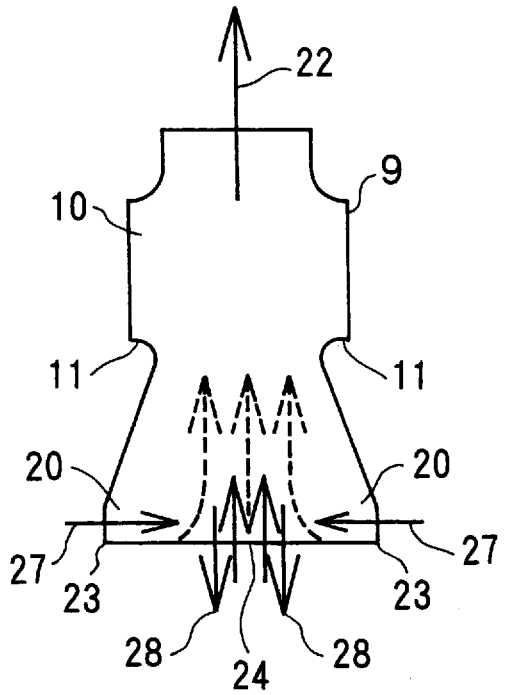
FIG. 3A PRIOR ART
FIGS. 3A and 3B are cross-sectional views of a rotary disk of a conventional gas turbine rotor, showing radial deformation of a surface of a inner hole in the rotary disk.
Figure 3B:
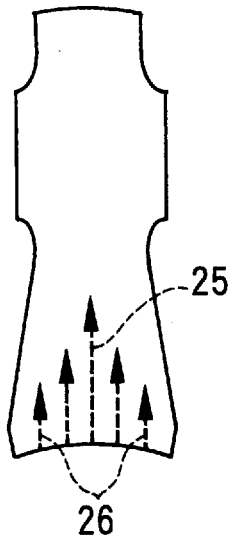
FIG. 3B PRIOR ART
Figure 3C:
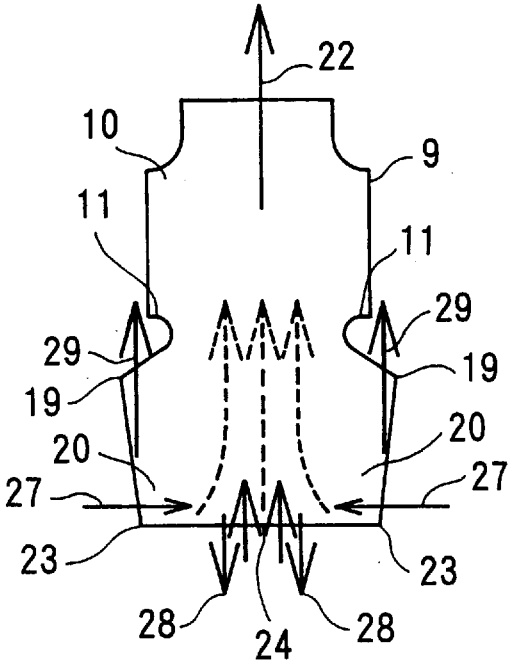
FIGS. 3C and 3D are cross-sectional views of the rotary disk of the gas turbine rotor according to the invention, showing radial deformation of a surface of an inner hole in the rotary disk.
Figure 3D:
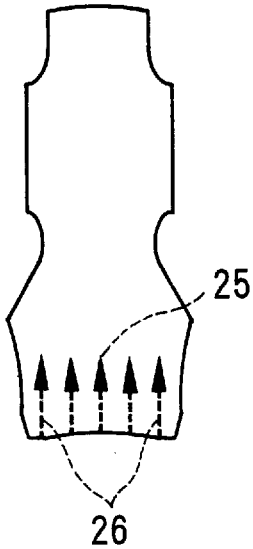
Figure 3D:
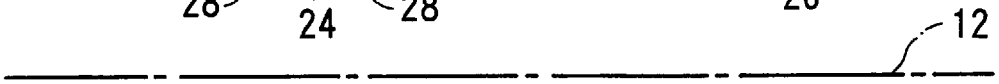

FIGS. 3A to 3D schematically show the effects of the embodiment. (In FIGS. 3A to 3D, solid-line arrows indicate a force, and broken-line arrows indicate deformation.) FIGS. 3A and 3B show the force and deformation exerted on a rotary disk in the form of a conventional equal-stress disk having hub portions 10. FIGS. 3C and 3D show the force and deformation exerted on the rotary disk of the present invention. FIGS. 3A and 3C show the condition before the deformation, and FIGS. 3B and 3D show the condition after the deformation. FIGS. 3B and 3D show the condition after the deformation, but show the rotary disks on a reduced scale as compared with the rotary disks before the deformation, and these should be construed as similar figures.

In the conventional construction shown in FIGS. 3A and 3B, the thickness of that portion of the rotary disk disposed radially inwardly of a hub-adjoining portion 17 is such that this portion has a configuration corresponding to an equal-stress disk. A centrifugal force 22, produced at moving blades and an outer peripheral portion of the rotary disk, acts more on a central portion 24 of a surface of an inner hole 18 than on opposite (right and left) end portions 23 of the inner hole 18. Also, since the thickness is the largest at a portion 21 in the vicinity of the central portion of the rotary disk, those portions (opposite side portions) 20 adjacent respectively to the opposite (right and left) sides (or surfaces) have high rigidity in the radial direction. Therefore, the difference between the radial deformation 25 of the central portion 24 of the surface of the inner hole 18 and the radial deformation 26 of each of the right and left end portions 23 of the surface becomes large, and therefore at the central portion 24 of the surface of the inner hole 18, compressive stress components 27 in the direction of the thickness, as well as shearing stress components 28 in directions between the radial direction and the direction of the thickness, become large, so that the peak correspondent stress at the surface of the inner hole 18 increases.

In this embodiment shown in FIGS. 3C and 3D, the thickness of those portions (opposite side portions) 20 of the hub-adjoining portion 17 adjacent respectively to the opposite (right and left) sides (or surfaces) is large, and therefore centrifugal forces 29, produced respectively at these portions 20 disposed radially inwardly of the hub-adjoining portion 19, are increased. Also, the thickness is decreasing continuously from the largest-thickness portion 19 to the inner hole 18, so that the radial rigidity of the portions 20, disposed adjacent respectively to the opposite (right and left) sides, is reduced at the portion 21 in the vicinity of the central portion of the rotary disk. Therefore, the difference between the radial deformation 25 of the central portion 24 of the surface of the inner hole 18 and the radial deformation 26 of each of the right and left end portions 23 of the surface is reduced, and therefore at the central portion 24 of the surface of the inner hole 18, compressive stress components 27 in the direction of the thickness, as well as shearing stress components 28 in directions between the radial direction and the direction of the thickness, are reduced. Further, the rigidity against the radial deformation is increased at the portion 21 in the vicinity of the central portion, thereby reducing the radial deformation 25 of the central portion 24 of the surface of the inner hole 18 so as to reduce circumferential stresses in the vicinity of the central portion 24 of the surface of the inner hole 18, so that the peak correspondent stress at the surface of the inner hole 18 can be reduced.

Figure 4:
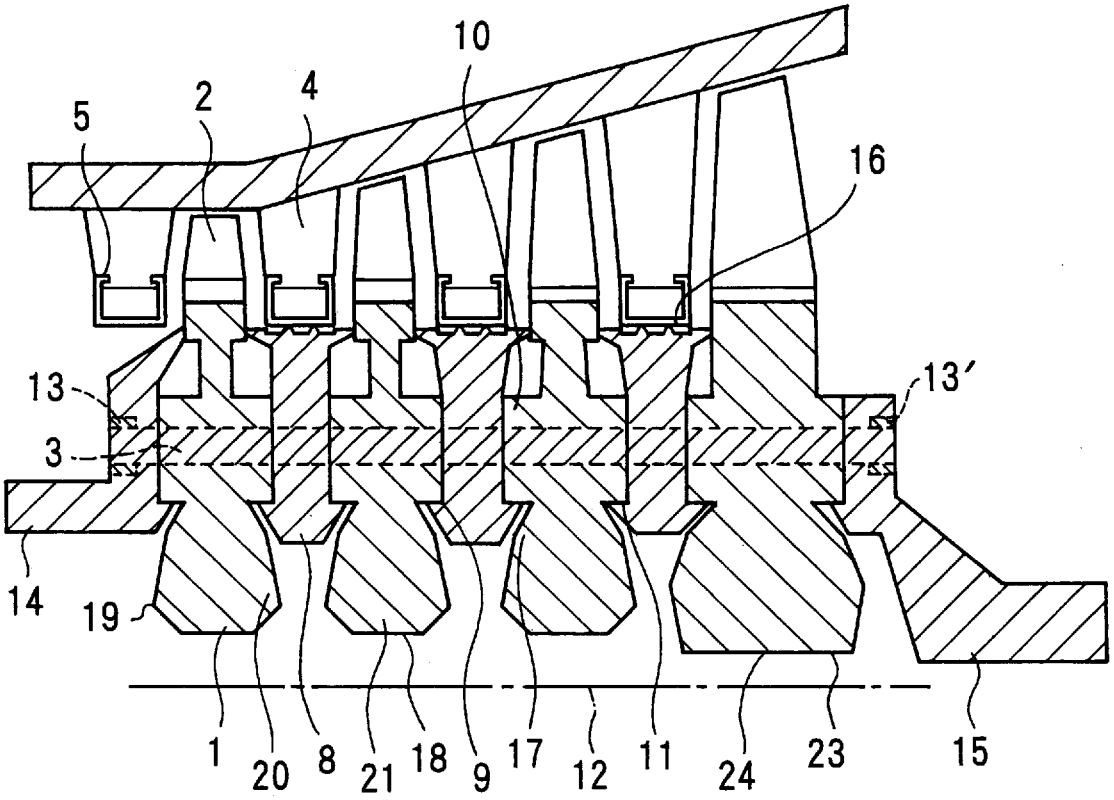
FIG. 4 is a cross-sectional view of a gas turbine rotor construction according to another embodiment of the invention, in which the thickness of a rotary disk is increasing in a stepped manner from a hub-adjoining portion to a largest-thickness portion.

In another embodiment of the invention shown in FIG. 4, the thickness of a rotary disk 1 is increasing in a stepped manner from a hub-adjoining portion 17 to a largest-thickness portion 19, and the thickness is decreasing continuously from the largest-thickness portion 19 to a central hole 18. With this configuration, the difference between the radial deformation of a central portion 24 of a surface of the inner hole 18 and the radial deformation of each of opposite (right and left) end portions 23 of the surface of the inner hole 18 is reduced, and also the radial deformation 25 of the central portion 24 is reduced, so that the peak correspondent stress at the surface of the inner hole 18 can be reduced.

Figure 5:
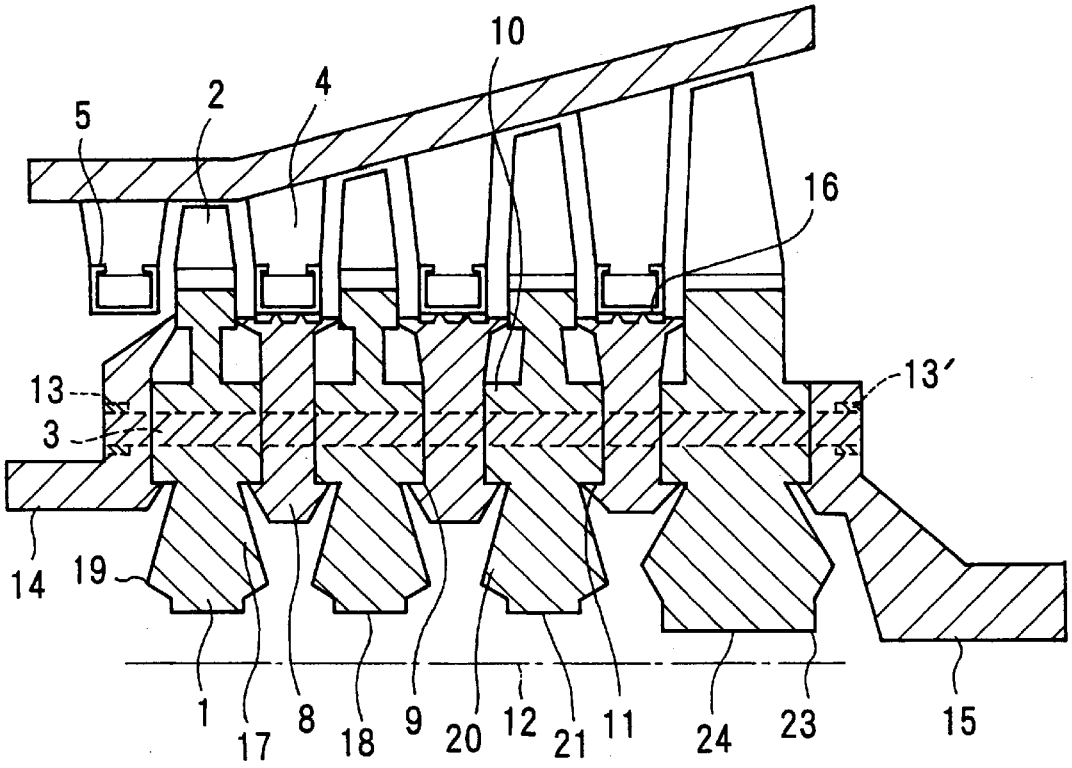
FIG. 5 is a cross-sectional view of a gas turbine rotor construction according to a further embodiment of the invention, in which the thickness of a rotary disk is decreasing in a stepped manner from a largest-thickness portion to an inner hole in the rotary disk.

In a further embodiment of the invention shown in FIG. 5, the thickness of that portion of a rotary disk 1, disposed radially inwardly of hub portions 10, is decreasing in a stepped manner from a largest-thickness portion 19 to an inner hole 18 in such a manner that part (or a given region) of that portion extending radially from the largest-thickness portion 19 to the inner hole 18 has a uniform thickness. In other words, the inner peripheral portion of the rotary disk 1, disposed immediately adjacent to the inner hole 18, has a uniform thickness. With this configuration, the difference between the radial deformation of a central portion 24 of a surface of the inner hole 18 and the radial deformation of each of opposite (right and left) end portions 23 of the surface of the inner hole 18 is reduced, and also the radial deformation 25 of the central portion 24 is reduced, so that the peak correspondent stress at the surface of the inner hole 18 can be reduced.

Figure 6:
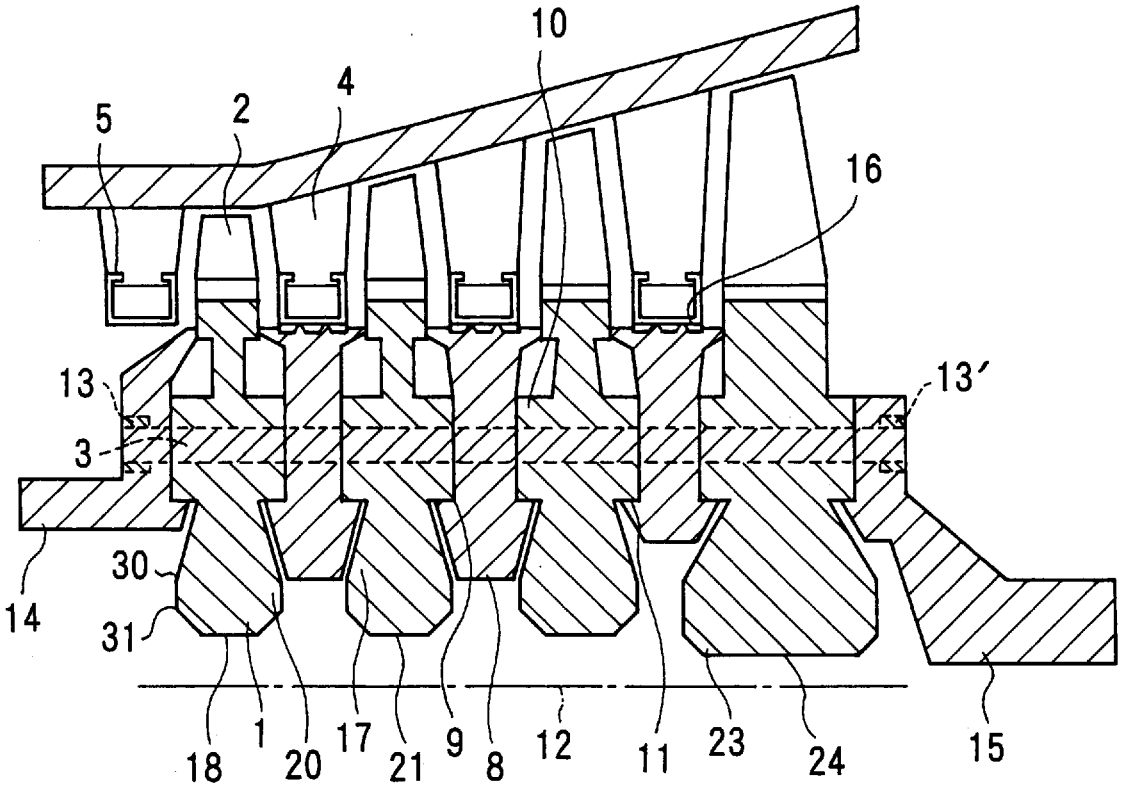
FIG. 6 is a cross-sectional view of a gas turbine rotor construction according to a yet another embodiment of the invention, in which a largest-thickness portion extends a predetermined distance radially of a rotary disk.

In yet another embodiment of the invention shown in FIG. 6, the thickness of that portion of a rotary disk 1 disposed radially inwardly of hub portions 10 is the largest not at one portion or position, but at a given region extending radially from an outer radial portion 30 to an inner radial portion 31, and the thickness is decreasing continuously from the largest-thickness inner radial portion 31 to an inner hole 18. With this configuration, the difference between the radial deformation of a central portion 24 of a surface of the inner hole 18 and the radial deformation of each of opposite (right and left) end portions 23 of the surface of the inner hole 18 is reduced, and also the radial deformation 25 of the central portion 24 is reduced, so that the peak correspondent stress at the surface of the inner hole 18 can be reduced.

Figure 7:
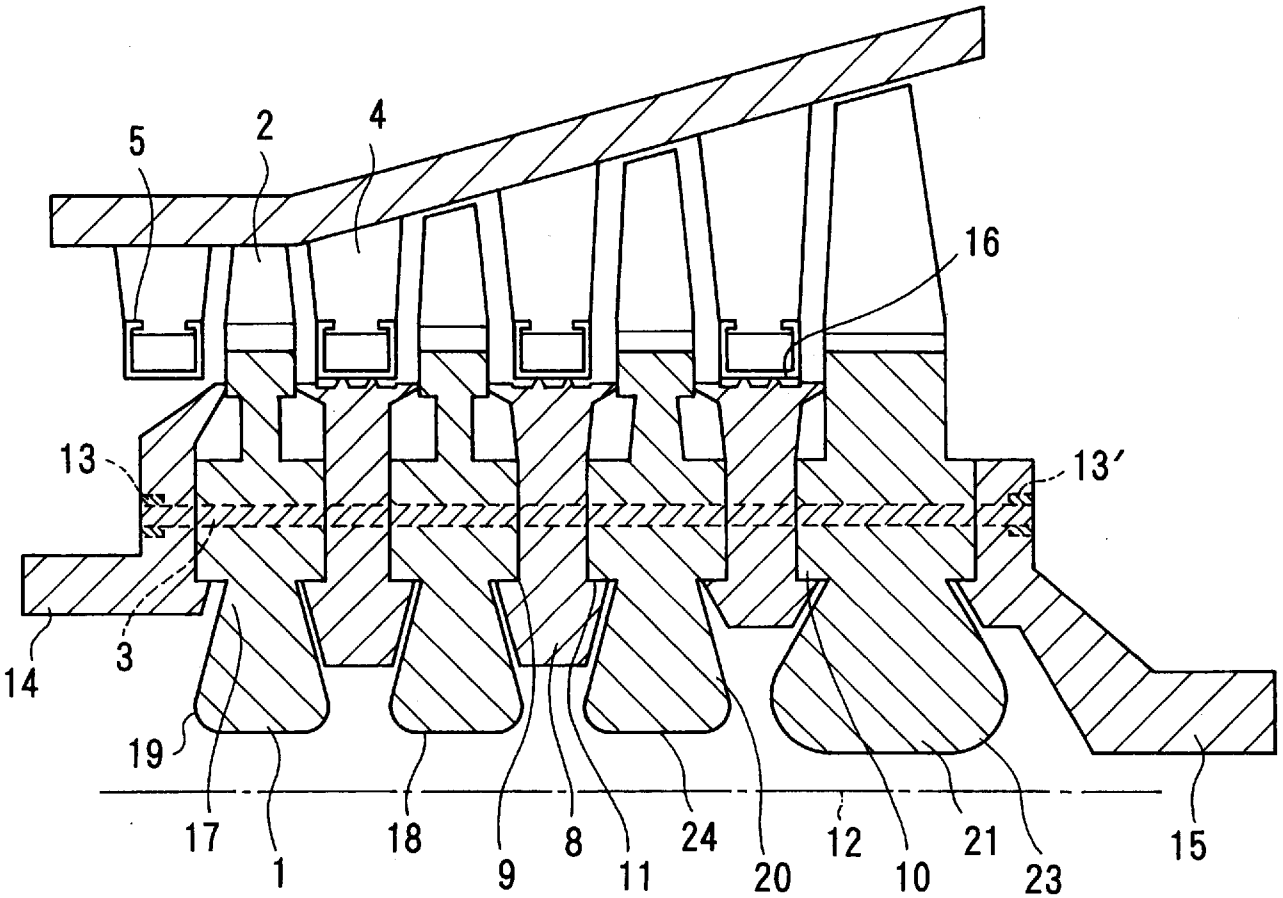
FIG. 7 is a cross-sectional view of a gas turbine rotor construction according to a still further embodiment of the invention, in which the thickness of a rotary disk is varying curvilinearly in a radical direction.
Figure 8:
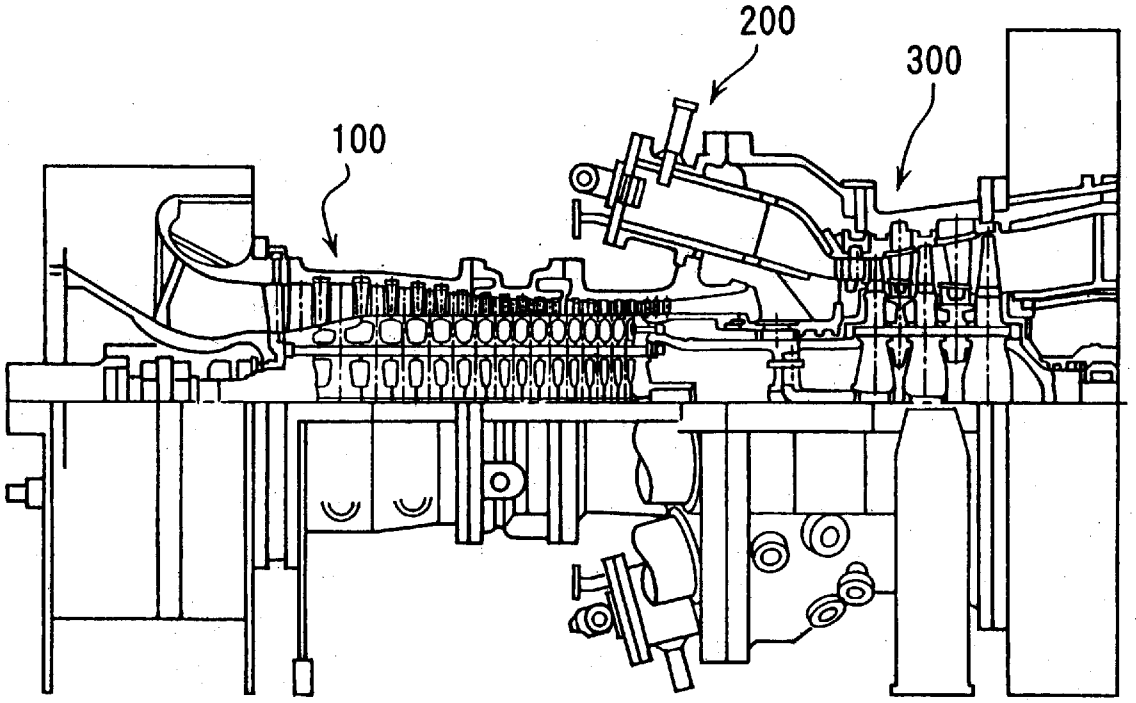
FIG. 8 PRIOR ART
FIG. 8 is a partly cross-sectional view showing an overall construction of a gas turbine.
Figure 9:
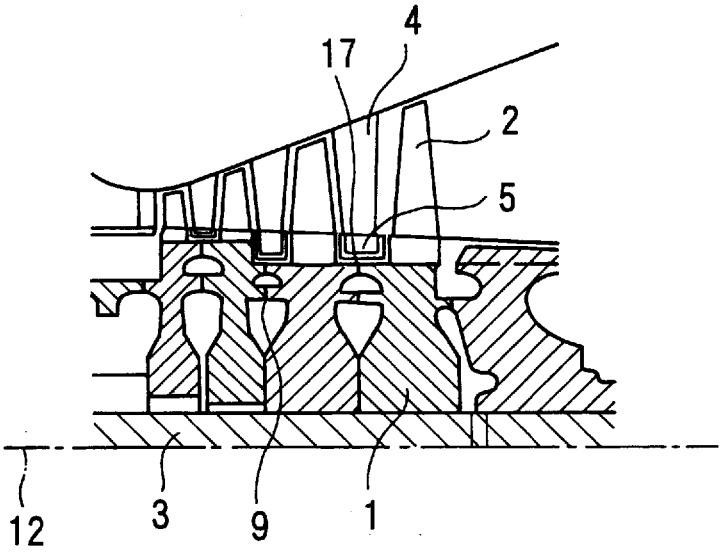
FIG. 9 PRIOR ART
FIG. 9 is a cross-sectional view of a conventional gas turbine rotor construction.

In a still further embodiment of the invention shown in FIG. 7, the thickness of a rotary disk 1 is increasing curvilinearly from a hub-adjoining portion 17 to a largest-thickness portion 19, and the thickness is decreasing curvilinearly from the largest-thickness portion 19 to an inner hole 18. With this configuration, that portion 21 in the vicinity of a central portion of the rotary disk 1 is formed into a cross-sectional shape similar to an elliptic shape, thereby making the produced stresses generally equal to one another, and therefore the difference between the radial deformation of a central portion 24 of a surface of the inner hole 18 and the radial deformation of each of opposite (right and left) end portions 23 of the surface of the inner hole 18 is reduced, so that the peak correspondent stress at the surface of the inner hole 18 can be reduced.

As described above, according to the present invention, the thickness of the rotary disk between the opposite (right and left) sides (or surfaces) is increased in the vicinity of the hub-adjoining portion, and those portions (opposite side portions) of the rotary disk, disposed adjacent respectively to the opposite (right and left) sides of the rotary disk, are reduced in thickness in the vicinity of the central portion of the rotary disk. With this configuration, the centrifugal forces, produced respectively at the opposite side portions in the vicinity of the central portion of the rotary disk, are increased, and also the radial rigidity of the opposite side portions is reduced. As a result, the radial deformation of those portions of the opposite side portions in the vicinity of the central portion of he rotary disk is increased, thereby reducing the difference between the radial deformation of the central portion of the surface of the inner hole and the radial deformation of each of the opposite end portions of the surface of the inner hole. And besides, since the rigidity against the radial deformation is increased in the vicinity of the central portion of the rotary disk, the radial deformation of the central portion of the surface of the inner hole is reduced. As a result, the compressive stress components in the direction of the thickness, as well as the stresses in the circumferential direction, are reduced, so that the peak correspondent stress at the surface of the inner hole can be reduced.

What is claimed is:

1. A gas turbine rotor comprising:

a plurality of rotary disks each having an opening of a circular shape formed through its central portion, each of said rotary disks including a pair of hub portions formed respectively on opposite sides thereof, and a pair of in-low portions formed respectively at the opposite sides thereof; and a plurality of spacers each having an opening of a circular shape formed through its central portion, each of said spacers having a pair of in-low portions formed respectively at opposite sides thereof, said rotary disks and said spacers being alternately stacked together in such a manner that the opposite sides of each of said spacers contact opposed side surfaces of the adjacent hub portions, respectively, and that said in-low portions of each of said spacers are engaged respectively with said in-low portions of the adjacent rotary disks, and said stack of rotary disks and spacers being fastened together in an axial direction by stacking bolts;

wherein a thickness of said portion of each of said rotary disks extending radially from an inner periphery of said hub portions to an inner peripheral surface of each said rotary disk is formed so that said thickness is the largest at a portion between the inner periphery of said hub portions and the inner peripheral surface of each said rotary disk, and that said thickness is decreasing from said largest-thickness portion to the inner peripheral surface of each said rotary disk, and the thickness of each of said rotary disks is decreasing in a stepped manner from said largest-thickness portion to the inner peripheral surface of each said rotary disk in such a manner that the part of said portion extending radially from said largest-thickness portion to the inner peripheral surface of each said rotary disk has a uniform thickness, so that stresses, developing at the inner peripheral surface of each said rotary disk, are made generally equal to one another over an entire area of the inner peripheral surface of each said rotary disk.

2. A gas turbine rotor comprising:

a plurality of rotary disks each having an opening of a circular shape formed through its central portion, each of said rotary disks including a pair of hub portions formed respectively on opposite sides thereof, and a pair of in-low portions formed respectively at the opposite sides thereof; and a plurality of spacers each having an opening of a circular shape formed through its central portion, each of said spacers having a pair of in-low portions formed respectively at opposite sides thereof, said rotary disks and said spacers being alternately stacked together in such a manner that the opposite sides of each of said spacers contact opposed side surfaces of the adjacent hub portions, respectively, and that said in-low portions of each of said spacers are engaged respectively with said in-low portions of the adjacent rotary disks, and said stack of rotary disks and spacers being fastened together in an axial direction by stacking bolts;

wherein a thickness of said portion of each of said rotary disks extending radially from an inner periphery of said hub portions to an inner peripheral surface of each said rotary disk is formed so that said thickness is the largest at a portion between the inner periphery of said hub portions and the inner peripheral surface of each said rotary disk, said largest-thickness portion extending a predetermined distance radially of each said rotary disk, and that said thickness is decreasing from a radially inner end of said largest-thickness portion to the inner peripheral surface of each said rotary disk, and the thickness of each of said rotary disks is decreasing in a stepped manner from said largest-thickness portion to the inner peripheral surface of each said rotary disk in such a manner that the part of said portion extending radially from said largest-thickness portion to the inner peripheral surface of each said rotary disk has a uniform thickness, so that stresses, developing at the inner peripheral surface of each said rotary disk, are made generally equal to one another over an entire area of the inner peripheral surface of each said rotary disk.

* * * * *